US008251065B2

(12) United States Patent
Kim

(10) Patent No.: US 8,251,065 B2
(45) Date of Patent: Aug. 28, 2012

(54) FOUR-SIDED DUSTPROOF MASK

(75) Inventor: Tae Gyu Kim, Gyeonggi-do (KR)

(73) Assignee: Jangjung Industrial Corp., Gyeonggi-Do (KR)

( * ) Notice: Subject to any disclaimer, the term of this patent is extended or adjusted under 35 U.S.C. 154(b) by 558 days.

(21) Appl. No.: 12/510,634

(22) Filed: Jul. 28, 2009

(65) Prior Publication Data

US 2010/0051032 A1 Mar. 4, 2010

(30) Foreign Application Priority Data

Sep. 1, 2008 (KR) ..... 10-2008-0085665

(51) Int. Cl.
*A62B 7/10* (2006.01)

(52) U.S. Cl. ..... 128/206.19; 128/206.21; 128/206.24

(58) Field of Classification Search . 128/205.27–206.19
See application file for complete search history.

(56) References Cited

U.S. PATENT DOCUMENTS 7,101,423 B2 * 9/2006 Lersch et al. ..... 96/68
7,171,967 B2 * 2/2007 Brunell et al. ..... 128/206.19
7,185,653 B2 * 3/2007 Lee ..... 128/206.19
7,845,351 B2 * 12/2010 Mathis et al. ..... 128/206.21

* cited by examiner

*Primary Examiner* — Glenn Richman
(74) *Attorney, Agent, or Firm* — Saliwanchik, Lloyd & Eisenschenk

(57) ABSTRACT

The present invention relates to a four-sided dustproof mask including: an upper filter adapted to surround a wearer's nose area; a lower filter adapted to surround the wearer's chin area; and a protruded center filter adapted to attach the upper filter and the lower filter thereto in such a manner as to make the both ends of the upper filter and the lower filter correspond to center points formed at the both ends of a curved folding line dividing the protruded center filter into two sides, the curved folding line having a straight line portion having a predetermined length protrudedly extended from the center points thereof, whereby while the upper filter and the lower filter are being developed, the protruded center filter is protruded to a dome-like shape.

7 Claims, 7 Drawing Sheets

FOUR-SIDED DUSTPROOF MASK

CROSS-REFERENCE TO RELATED APPLICATION

This application claims the benefit under 35 U.S.C. §119 of Korean Patent Application No. 10-2008-0085665, filed Sep. 1, 2008, which is hereby incorporated by reference in its entirety.

BACKGROUND OF THE INVENTION

The present invention relates to a dustproof mask, and more particularly, to a four-sided dustproof mask that substantially reduces the area abutting against a wearer's cheeks, while having a filter protruded forwardly from the mouth of the wearer to increase a dust-filtering area thereof, thereby providing high dust-filtering performance when the mask is worn.

Generally, dustproof masks are widely used in a variety of industrial fields. For example, the dustproof masks are worn on a wearer's face for providing good breathing conditions to the wearer when he or she works at chemical factories where poisonous gas is ejected, at metal refining sites where metal powder and welding fumes are generated, and at paper-making or spinning and weaving factories. Furthermore, the dustproof masks are worn to provide a clean working space at semiconductor laboratories (or semiconductor manufacturing sites) where the generation of the dust is severely restricted, which is primarily intended to obtain a better quality of product as opposed to concern over the health of the wearer.

On the other hand, the dustproof masks are worn during people's daily life, and recently, they are worn in spring during which sand dust like Asian dust is frequently generated. In addition, as air pollution becomes more severe day by day, the number of peoples wearing the dustproof masks is increased to protect their breathing from various dust.

Wearing the dustproof mask is to inhale substantially refresh air by filtering external polluted air, and therefore, the dust-filtering performance is improved by enhancing a quality of a filter. In addition to the improvement of the quality of the filter, however, the enlargement of the dust-filtering area of the filter is also important. In conventional dustproof masks, the both sides of the filter to which ear bands are attached are contacted face to face with the cheeks of the wearer when the mask is worn, such that the dust-filtering area is defined as the area of the filter existing around the mouth of the wearer, thereby undesirably causing a relatively small dust-filtering area when compared with the entire size of the filter.

BRIEF SUMMARY

Accordingly, the present invention has been made in view of the above-mentioned problems occurring in the prior art, and it is an object of the present invention to provide a four-sided dustproof mask that obtains a substantially large dust-filtering area with respect to the size of a filter thereof.

It is another object of the present invention to provide a four-sided dustproof mask that has a filter disposed in front of the mouth of a wearer in such a manner as to be protruded to a dome-like shape when the dustproof mask is worn, while the both sides of the filter to which ear bands are attached are being line-contacted with the cheeks of the wearer, thereby minimizing the contacting area between the filter and the wearer's cheeks and increasing the dust-filtering area of the filter.

To accomplish the above objects, according to the present invention, there is provided a four-sided dustproof mask including: an upper filter adapted to surround a wearer's nose area; a lower filter adapted to surround the wearer's chin area; and a protruded center filter adapted to attach the upper filter and the lower filter thereto in such a manner as to make the both ends of the upper filter and the lower filter correspond to center points formed at the both ends of a curved folding line dividing the protruded center filter into two sides, the curved folding line having a straight line portion having a predetermined length protrudedly extended from the center points thereof, whereby while the upper filter and the lower filter are being developed, the protruded center filter is protruded to a dome-like shape.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Hereinafter, an explanation of a four-sided dustproof mask according to the present invention will be in detail given with reference to the attached drawings.

Figure 1:
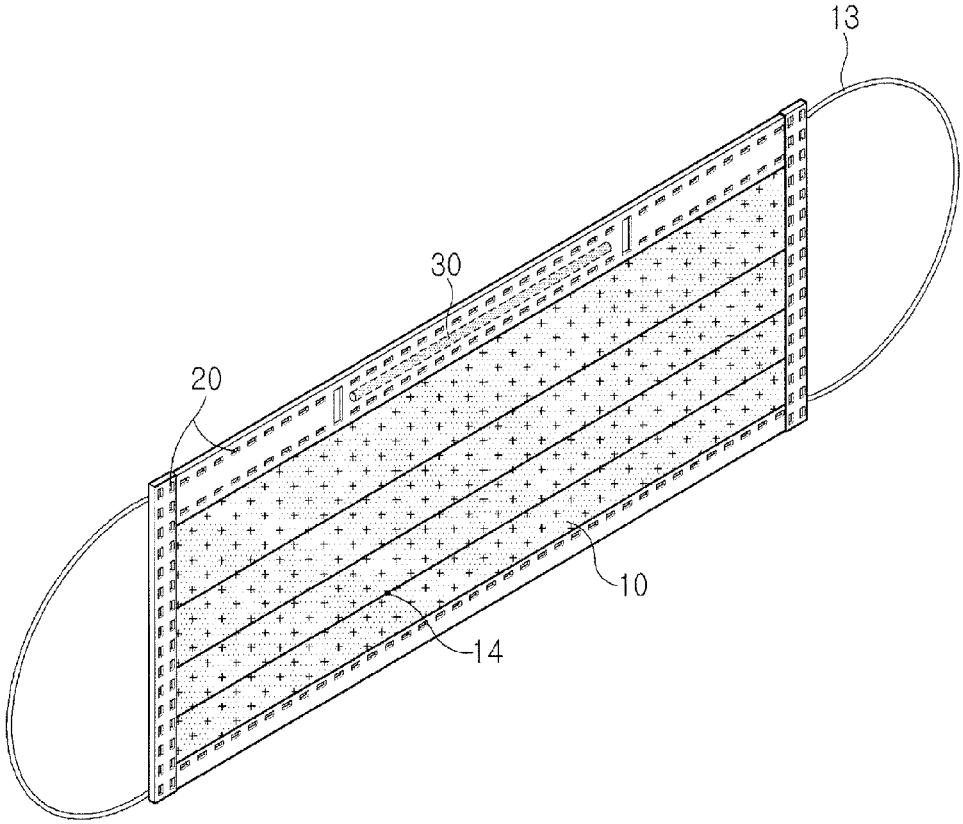
FIG. 1 is a perspective view showing a conventional fold type dustproof mask.

FIG. 1 is a perspective view showing a conventional fold type dustproof mask, and as shown, a center filter 10 has a plurality of fold parts 14. The fold parts 14 serve to increase the area of the center filter 10 for covering a wearer's face area and also serve to reduce the volume thereof while the mask is distributed to the market. The center filter 10 has a generally triple structure formed of an outer cover, a middle cover and an inner cover, so as to obtain high dust-filtering performance. The center filter 10 has a bent wire 30 insertedly disposed on the upper portion thereof.

The bent wire 30 is made of a freely bendable plastic material adapted to be brought into close contact with the curves of the nose area of the wearer, so as to improve the dust-proofing effect when the dustproof mask is worn. On the other hand, the sewing of the center filter 10 and the attachment of ear bands 13 are achieved by the formation of bonding parts 20 through thermal bonding using general ultrasonic technology.

Figure 2:
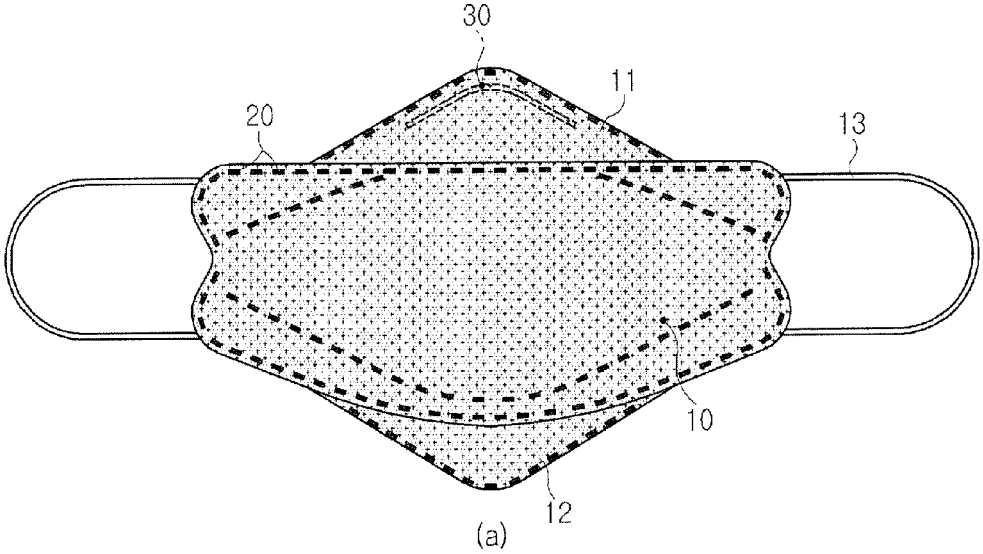
FIGS. 2*a* and 2*b* are front and rear views showing a conventional three-sided dustproof mask.
Figure 2:
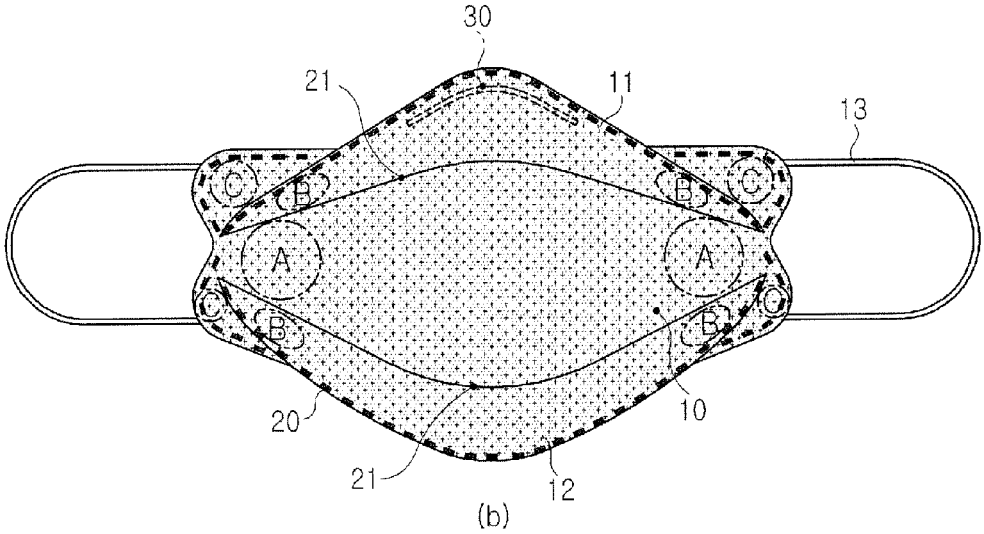

FIG. 2*a* is a front view showing a conventional three-sided dustproof mask, and the conventional three-sided dustproof mask includes a center filter 10 adapted to surround the mouth area of a wearer, an upper filter 11 to surround a part of the nose area of the wearer, and a lower filter 12 to surround the chin area of the wearer. Each fitter of the three-sided dustproof mask also has a generally triple structure formed of an outer cover, a middle cover and an inner cover, so as to obtain high dust-filtering performance.

FIG. 2*b* is a rear view showing the conventional three-sided dustproof mask having the center filter 10, the upper filter 11, and the lower filter 12, wherein the face-contact areas of the filters contacting with the cheeks of the wearer when the mask is worn are indicated. As shown, the upper filter 11 is thermally bonded to the upper portion of the center filter 10 about an upper folding line 21 by the formation of a bonding part 20 through the application of ultrasonic waves, and in the same manner as above, the lower filter 12 is thermally bonded to the lower portion of the center filter 10 about a lower folding line 21 by the formation of the bonding part 20 through the application of ultrasonic waves.

The upper filter 11 and the lower filter 12 are folded about the corresponding upper and lower folding lines 21 in such a manner as to be faced to the center filter 10, which enables the three sides of the dustproof mask to be flat when the mask is packed or while it is not used. If it is desired to use the dustproof mask, the upper filter 11 and the lower filter 12 are unfolded about the upper and lower folding lines 21, and then, the mask is covered on the nose, cheeks and chin of the wearer. In this case, the face-covering performance becomes high by the formation of the bent wire 30 inserted into the upper filter 11, and when the ear bands 13 are hung on the wearer's ears, the mask is worn to a shape of an air chamber covering the mouth and nose areas of the wearer.

When the conventional three-sided dustproof mask is worn, as shown in FIG. 2*b*, the areas 'A' of the center filter 10, the areas 'B' of the upper and lower filters 11 and 12, and the areas 'C' of the center filter 10 to which the ear bands 13 are attached are contacted face to face with the cheeks of the wearer, such that the dust-filtering area of the three-sided dustproof mask worn to the shape of the air chamber is defined as the area of the center filter 10 existing around the mouth of the wearer.

Figure 3:
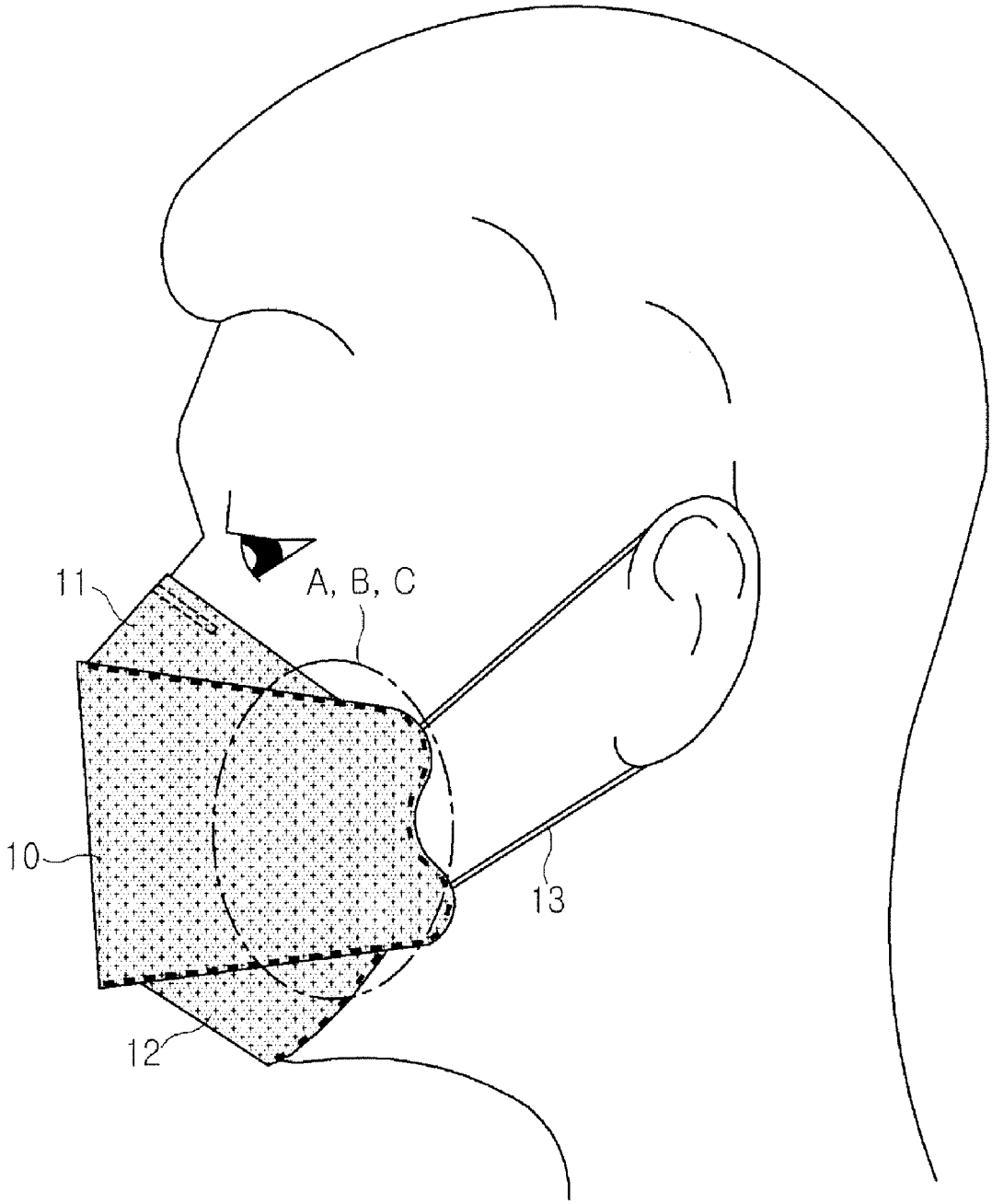
FIG. 3 is a perspective view showing a wearing state of the conventional three-sided dustproof mask.

That is, the areas 'A, B and C' of the conventional three-sided dustproof mask are contacted fact to face with the cheeks of the wearer, as shown in an oval circle of FIG. 3, such that the dust-filtering operation made during inhalation is exerted only on the area defined on the center filter 10 spaced forwardly apart from the mouth of the wearer, and it is not exerted on the areas 'A, B and C' contacting with the cheeks of the wearer, thereby causing a relatively small dust filtering area about the entire area of the center filter 10.

On the other hand, the conventional fold type dustproof mask as shown in FIG. 1 does not take a cup-like air chamber shape when it is worn, and the center filter 10 is brought into contact with the mouth of the wearer, such that the wearer's saliva or lip rouge is painted on the center filter 10, which makes the mask frequently exchanged with new one, thereby undesirably shortening the use period thereof.

Accordingly, the present invention provides a four-sided dustproof mask that has a relatively large dust-filtering area with respect to the entire area of the center filter 10 to obtain high dust-filtering performance and that reduces the volume of the dustproof mask while the mask is being stored or distributed. Hereinafter, the four-sided dustproof mask according to the present invention will be explained with reference to FIGS. 4 to 8, wherein the same parts as the conventional parts will be designated with the same reference numerals as in the conventional dustproof masks.

Figure 4:
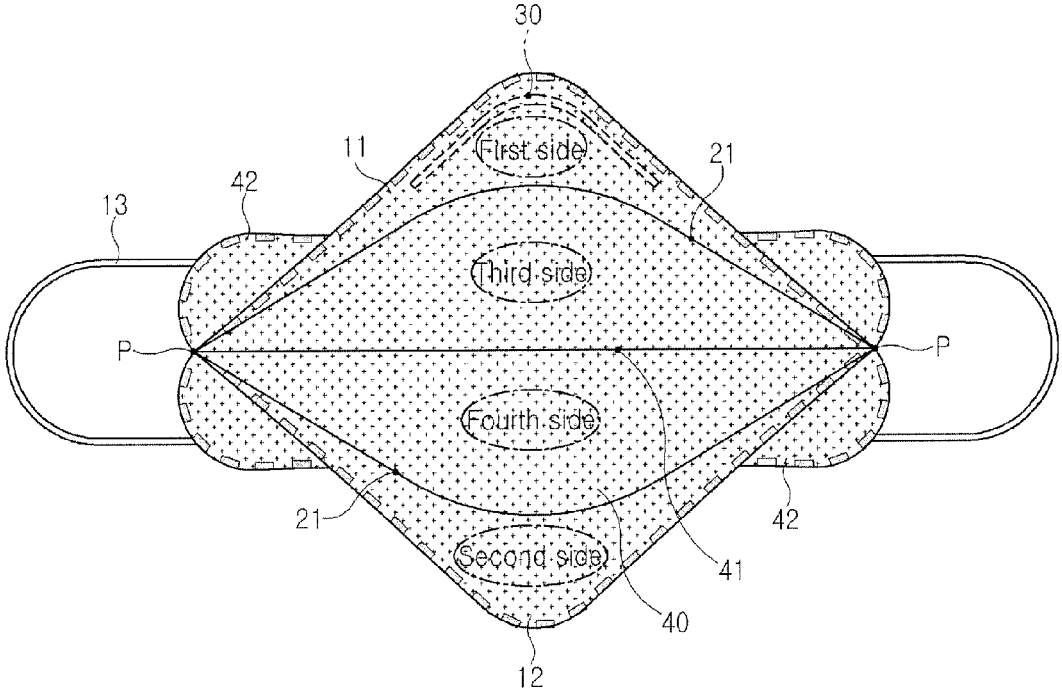
FIG. 4 is a rear view showing a four-sided dustproof mask according to the present invention.

FIG. 4 is a rear view showing a four-sided dustproof mask according to the present invention. As shown, an upper filter 11 and a lower filter 12 about the upper and lower folding lines 21 become first and second sides, and a protruded center filter 40 is divided into two sides, that is, third and fourth sides, about a curved folding line 41. In an embodiment, the upper filter 11 and the lower filter 12 are curved like the shape of the folding lines 21 in such a manner as to present them to be thermally bonded to the protruded center filter 40 by the formation of bonding parts 20 through the application of the ultrasonic waves. At the time of thermally bonding the upper filter 11 and the lower filter 12 to the protruded center filter 40, the both ends of the upper filter 11 and the lower filter 12 are positioned correspondingly at center points P indicated on the both ends of the curved folding line 41 dividing the protruded center filter 40 into the two sides.

On the other hand, the upper filter 11 has a bent wire 30 insertedly disposed on the upper portion thereof, the bent wire 30 being freely bendable along the curves of the nose area of the wearer, thereby coming into close contact with the curves of the nose area of the wearer when the dustproof mask is worn. Also, the ear bands 13 are attached on the both sides of the protruded center filter 40, and the portions on which the ear bands 13 are attached are called band-attaching parts 42.

Figure 5:
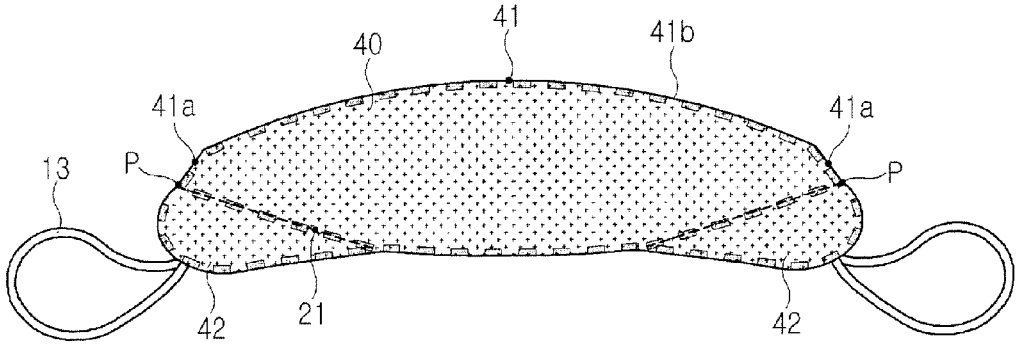
FIG. 5 is a perspective view showing a folded state of the four-sided dustproof mask according to the present invention.
Figure 6:
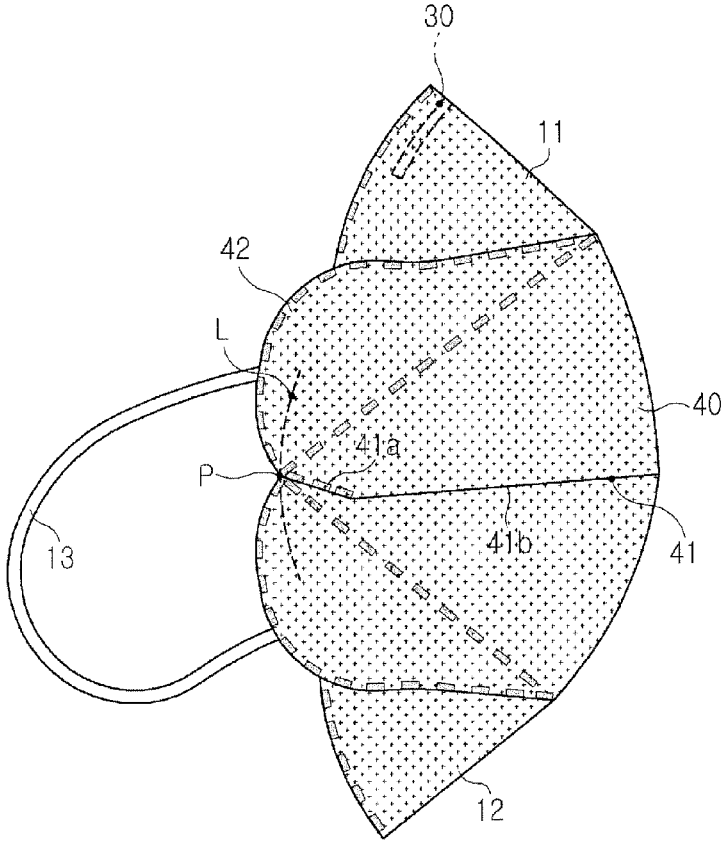
FIG. 6 is a side view showing the four-sided dustproof mask according to the present invention.
Figure 7:
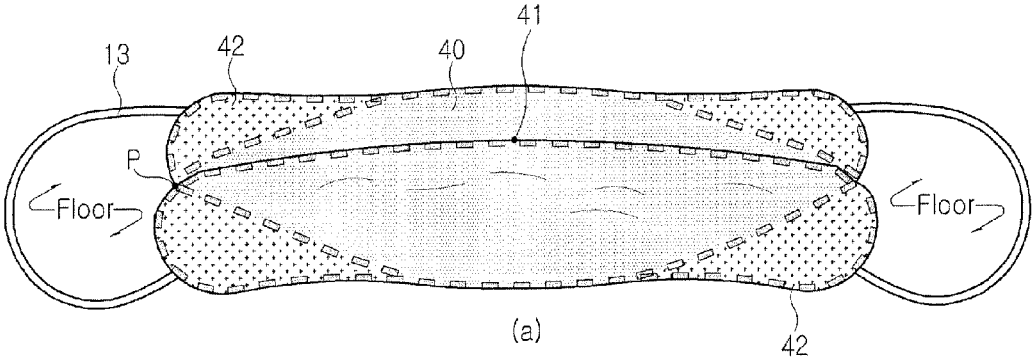
FIGS. 7*a* and 7*b* are perspective views showing a protruded center filter of the four-sided dustproof mask according to the present invention.
Figure 7:
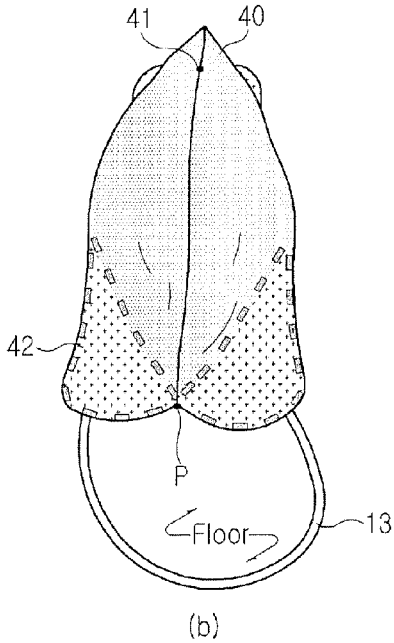

FIG. 5 is a perspective view showing a folded state of an embodiment of the four-sided dustproof mask according to the present invention, and FIG. 6 is a side view showing an embodiment of the four-sided dustproof mask according to the present invention. As shown in FIG. 5, the four-sided dustproof mask according to the present invention is folded to a banana-like shape while the mask is stored or distributed. In more detail, the upper filter 11 and the lower filter 12 are folded inwardly about the upper and lower folding lines 21 toward the protruded center filter 40, and in the state where the upper filter 11 and the lower filter 12 are folded, the protruded center filter 40 is folded in half about the curved folding line 41, such that the curved folding line is curved like a banana-like shape. The curved folding line 41 serves to divide the protruded center filter 40 into the two sides, and as shown in FIG. 5, the curved folding line 41 is protrudedly extended to straight line portions 41*a* from the center points P thereof and is further extended to a curved portion 41*b* from the straight line portions 41*a*.

When the folded four-sided dustproof mask is developed, as shown in FIG. 6, the protruded center filter 40 is unfolded protruded forwardly, which is allowed by the protruded formation of the straight line portions 41*a* of the curved folding line 41 about the center points P when the upper filter 11 and the lower filter 12 are held and unfolded upwardly and downwardly.

Further, in an embodiment the upper filter 11 and the lower filter 12 can be thermally bonded correspondingly to the center points P indicated on the both ends of the curved folding line 41 dividing the protruded center filter 40 into the two sides, such that while the mask is being developed, a line-contacting line L is formed about each of the center points P, as shown in FIG. 6. As a result, the four-sided dustproof mask is line-contacted about the line-contacting line L with the cheeks of the wearer when the mask is worn, thereby increasing a dust-filtering area of the mask.

This aspect of the subject invention is in contrast to conventional masks, which come into face-contact with the checks of the wearer on the both sides thereof, which substantially reduces the dust-filtering area of conventional masks.

FIGS. 7*a* and 7*b* are perspective views showing the protruding degree of the protruded center filter 40 of the four-sided dustproof mask according to an embodiment of the present invention, wherein FIG. 7*a* shows the state where the four band-attaching parts 42 to which the ear bands 13 are attached are unfolded and disposed on a floor, and FIG. 7*b* shows the side view of FIG. 7*a*.

As shown in FIGS. 7*a* and 7*b*, an embodiment of the four-sided dustproof mask according to the present invention is made in the state where the protruded center filter 40 is protruded forwardly to the dome-like shape even in the state where the upper filter 11 and the lower filter 12 are not developed. As mentioned above, the line-contacting lines L are formed upon the wearing of the mask to allow the both sides of the mask to be line-contacted with the cheeks of the wearer, such that the dust-filtering areas of the filters can be substantially increased.

Figure 8:
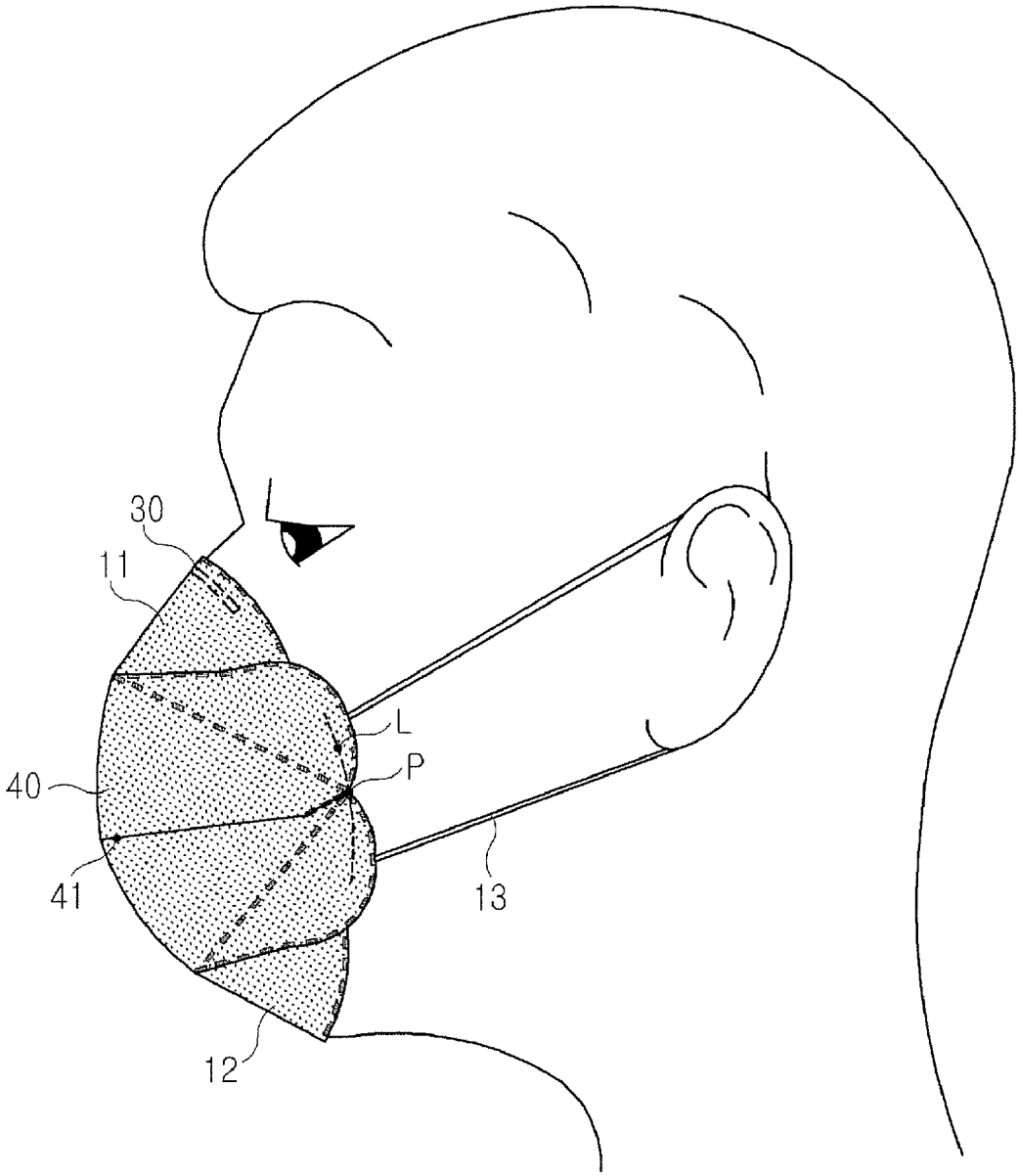
FIG. 8 is a perspective view showing a wearing state of the four-sided dustproof mask according to the present invention.

FIG. 8 is a perspective view showing a wearing state of an embodiment of the four-sided dustproof mask according to the present invention. The upper filter 11 is developed to enable the bent wire 30 to be brought into close contact with the ridge of the nose, and the lower filter 12 is developed downwardly to the lower portion of the chin. After that, when the ear bands 13 are hung on the ears, the four-sided dustproof mask according to the present invention is line-contacted with the cheeks of the wearer along the line-contacting lines L about the center points P, thereby minimizing the contacting area between the filter and the cheeks, increasing the dust-filtering areas of the filter, and improving the entire function of the mask.

As described above, the four-sided dustproof mask according to the present invention obtains a substantially large dust-filtering area about the size of the filter thereof, thereby achieving high dust-filtering performance to provide a good health condition to the wearer, and further, it is foldable to four sides, thereby saving the logistics costs including packing costs while the mask is stored and/or distributed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A four-sided dustproof mask, comprising:

an upper filter adapted to surround a wearer's nose area;

a lower filter adapted to surround the wearer's chin area;

a protruded center filter adapted to attach the upper filter and the lower filter thereto in such a manner as to make the both ends of the upper filter and the lower filter correspond to center points formed at the both ends of a curved folding line dividing the protruded center filter into a top portion and a bottom portion, the curved folding line having at least two straight line portions, each straight line portion having a predetermined length and protrudedly extending, from one of the center points, whereby while the upper filter and the lower filter are being developed, the protruded center filter is protruded to a dome-like shape; and at least two curved band-attaching parts protruding from the center filter and configured to attach the dustproof mask to one or more ear bands.

2. The dustproof mask according to claim 1, wherein the upper filter comprises a bent wire disposed in an upper portion thereof, wherein the bent wire is configured to bend freely along curves of the wearer's nose area.

3. The dustproof mask according to claim 1, wherein the at least two straight line portions of the curved folding line are configured such that a line-contacting line is formed about each of the center points, wherein each line-contacting line is configured to contact a cheek area of the wearer.

4. The dustproof mask according to claim 1, wherein at least one band-attaching part protrudes from the top portion of the center filter and at least one band-attaching part protrudes from the bottom portion of the center filter.

5. The dustproof mask according to claim 1, wherein at least two band-attaching parts protrude from the top portion of the center filter and at least two band-attaching parts protrude from the bottom portion of the center filter.

6. The dustproof mask according to claim 5, wherein the at least two straight line portions of the curved folding line are configured such that a line-contacting line is formed about each of the center points, wherein each line-contacting line is configured to contact a cheek area of the wearer.

7. The dustproof mask according to claim 6, wherein the upper filter comprises a bent wire disposed in an upper portion thereof, wherein the bent wire is configured to bend freely along curves of the wearer's nose area.

* * * * *